US011828561B2

(12) United States Patent
Karlo et al.

(10) Patent No.: US 11,828,561 B2
(45) Date of Patent: Nov. 28, 2023

(54) MAGAZINE FOR FIREARMS

(71) Applicant: GLOCK TECHNOLOGY GMBH, Ferlach (AT)

(72) Inventors: Markus Karlo, Vienna (AT); Jürgen Gunsam, Prottes (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 71 days.

(21) Appl. No.: 17/755,915

(22) PCT Filed: Nov. 13, 2020

(86) PCT No.: PCT/EP2020/082014
§ 371 (c)(1),
(2) Date: May 11, 2022

(87) PCT Pub. No.: WO2021/099219
PCT Pub. Date: May 27, 2021

(65) Prior Publication Data

US 2022/0381528 A1 Dec. 1, 2022

(30) Foreign Application Priority Data

Nov. 22, 2019 (EP) ..... 19210900

(51) Int. Cl.
*F41A 9/67* (2006.01)
*F41A 9/62* (2006.01)
*F41A 9/07* (2006.01)

(52) U.S. Cl.
CPC . *F41A 9/07* (2013.01); *F41A 9/62* (2013.01)

(58) Field of Classification Search
CPC ..... F41A 9/66; F41A 9/67
USPC ..... 42/49.01, 49.02, 49.1, 50
See application file for complete search history.

(56) References Cited

U.S. PATENT DOCUMENTS 1,245,499 A * 11/1917 Orme ..... F41A 17/38 124/52
2,137,491 A * 11/1938 Huff ..... F41A 9/67 42/50
2,885,811 A * 5/1959 Womble, Jr. ..... F41A 17/20 42/50
5,375,359 A * 12/1994 Chesnut ..... F41A 9/67 42/50
9,846,004 B2 12/2017 Micllef
2011/0107639 A1* 5/2011 Douglas ..... F41A 9/67 42/50
2012/0131830 A1* 5/2012 Froehle ..... F41A 9/67 42/49.01
2014/0373416 A1 12/2014 Barnhart
2018/0231339 A1 8/2018 Walton
2018/0292154 A1* 10/2018 Maga ..... F41A 17/38
(Continued)

FOREIGN PATENT DOCUMENTS

GB 110577 A 10/1917

*Primary Examiner* — Bret Hayes
(74) *Attorney, Agent, or Firm* — Raven Patents, LLC; Anton E. Skaugset

(57) ABSTRACT

A magazine for a firearm, including a magazine body having at least one slit in the side, a feeder comprising a slide receptacle, and a loading aid. The loading aid includes a first and second slide which are designed so as to be able to be coupled inside the slide receptacle by means of a latch, and the feeder includes at least one hole, for uncoupling the latch, in the direction of the slide receptacle.

21 Claims, 6 Drawing Sheets

(56) References Cited

U.S. PATENT DOCUMENTS

| | | | | |
|---|---|---|---|---|
| 2019/0072348 | A1* | 3/2019 | Samsel | F41A 9/67 |
| 2019/0219348 | A1* | 7/2019 | Maga | F41A 17/38 |
| 2019/0219352 | A1 | 7/2019 | Maga | |
| 2020/0064091 | A1* | 2/2020 | Bush | F41A 9/71 |

* cited by examiner

MAGAZINE FOR FIREARMS

TECHNICAL FIELD

The present disclosure relates generally to firearms, and more specifically to improved magazines for firearms.

BACKGROUND

In the case of most semi-automatic and automatic firearms, the cartridge (ammunition) feed can be achieved for example by means of a magazine. Conventional forms of magazine for semi- and fully-automatic firearms are for example the box magazine, stick magazine and curved magazine.

A magazine generally comprises an elongated body having a largely rectangular cross section. The upper end comprises magazine lips and an opening in order to be able to transport the top cartridge, in each case, into the chamber of a firearm. The lower end comprises a magazine butt that is connected to the magazine body. Between the upper and lower end, viewed from the top, the magazine body contains a feeder that is connected to a magazine spring, the magazine spring being connected directly, or by means of a base plate, to the magazine butt.

The spring force of the spring pushes the feeder upwards and, when the magazine is empty, as far as the magazine lips. For the purpose of filling, cartridges are pushed from above, through the opening and into the magazine, in such a way that the feeder is pushed slightly downwards, counter to the spring force, in each case. The spring is pre-tensioned more strongly with each cartridge that is additionally inserted into the magazine, and therefore insertion of the next cartridge, in each case, into the magazine requires an ever stronger downward force. Filling of the magazine is furthermore impeded by the round cartridge cases possibly sliding off one another, and the design that tapers towards the cartridge tip and, in the case of rimfire cartridges, the larger diameter of the cartridge base compared to the sleeve, also make the process more difficult. Conventional filling of a magazine with cartridges is therefore accordingly difficult, in particular the more a magazine is already filled. The filling accordingly requires time, dexterity and force.

Accordingly, loading aids have long been known in the prior art, which facilitate filling of magazines with cartridges.

U.S. Pat. No. 9,846,004 B2 and US 2018/231 339 A1, for example, each disclose a magazine comprising a slit in one of the side walls, and a feeder comprising an opening, on which a tool can be set against a side of the magazine, in order to push the feeder downwards. Setting the tool on one side is disadvantageous in that canting and jamming of the feeder may occur when it is being pushed down. A further disadvantage is that the loading aid is present only in the combination: "magazine with tool," so a separate tool is required.

US 2019/219 352 A1 discloses a magazine comprising a lateral slit and a knob that is attached to one side of the feeder and protrudes beyond the magazine body, at which knob the feeder can be pushed downwards. Attaching the knob on one side means that canting and jamming of the feeder is possible. The non-flush finish of the knob with the magazine body also has a disadvantageous effect. A loading aid of this kind that protrudes beyond the magazine body and is rigidly connected to the feeder is also disclosed in US 2016/003 568 A1. A loading aid that protrudes beyond the magazine body cannot be easily introduced into the magazine well of a firearm; particular designs are necessary which for example require more space and material, and/or result in heavier magazines.

GB 110577 A discloses a magazine comprising a slit on both sides, and a loading aid which is attached in the magazine by means of a thread and can be operated from both sides. The necessarily laborious manufacture of the thread: as well as the lack of loss proofing, have a disadvantageous effect.

For the jurisdictions in which this is possible, the content of these documents is incorporated, by reference, into the content of the disclosure of this application.

The object of the present disclosure is that of preventing the mentioned disadvantages of the prior art and of providing a magazine with an easily collapsible loading aid, which exhibits a reduced risk of loss. A further object for embodiments of the disclosure is that of providing an optimized, reliable magazine, and making the loading state of the magazine both visually and/or physically identifiable without having to manipulate the firearm.

SUMMARY

The present disclosure is directed to a magazine for a firearm, including a magazine body having two sides, including at least one slit in each of the two sides; a feeder, the feeder defining a slide receptacle extending through the feeder; and a loading aid. The loading aid includes a first and a second slide that are configured to be reversibly coupled to each other inside the slide receptacle by a latch, so that a first side face of the first slide and a second side face of the second slide are each disposed outside the magazine body; and the feeder defines at least one hole in a direction of the slide receptacle to permit an uncoupling of the latch.

BRIEF DESCRIPTION OF THE DRAWINGS

The magazines of the present disclosure will be described in greater detail in the following, with reference to the drawings, in which.

DETAILED DESCRIPTION

Figure 1B:
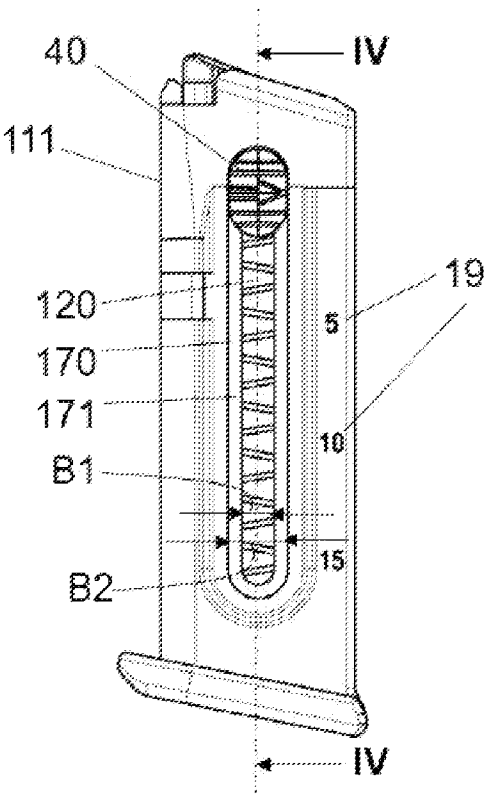
FIGS. 1A and 1B are a perspective exploded view and a side view, respectively, of an illustrative magazine according to the present disclosure.

The magazines according to the present disclosure include modifications of magazines that are known per se, for example for pistols and other firearms. The improvements can be achieved by virtue of the magazines including a collapsible loading aid which can be installed in a simple manner, without tools, in a manner that is loss-proof, and that can be removed from the magazine easily and requiring only a simple tool.

Throughout the present disclosure and the appended claims, "front" or "forwards" refers to the direction towards the muzzle of the barrel of the firearm, "rear(wards)" refers to the direction towards the stock, "bottom" or "downwards" refers to the direction from the magazine lips towards the magazine butt, and "top" or "upwards" refers to the direction from the magazine butt towards the magazine lips.

Similarly, as used herein "lateral surfaces" refer both to the left-hand and right-hand surfaces between the front and rear end of the firearm, as viewed in the muzzle direction. The designations "magazine," "feeder," "magazine butt," "magazine plate," etc. have the conventional meaning that a person skilled in the art attributes to them in the prior art. Surfaces that are "in parallel" with an axis form cylindrical lateral surfaces, "recesses" relate to the surrounding regions of the object considered, etc.

The magazines of the present disclosure include a loading aid with a decreased risk of loss but that is nonetheless easily collapsible. Over the entire vertically displaceable region, the loading aid is designed so as to be set back with respect to, or at most flush with, the contour of the magazine body. As a result, the magazine can be used in a firearm in a very trouble-free manner, and in a manner preventing jamming, even when said magazine has an in-built loading aid. Furthermore, the loading aid can be brought into a collapse position, and subsequently collapsed, merely using a simple tool, e.g. a collapse pin, by means of light pressure on at least one latch-forming projection, through the collapse opening/the hole.

It has been found to be particularly advantageous for the loading aid to comprise two slides that can be inserted into one another. The sides are designed so as to be complementary in shape to one another, comprising a bolt holder and a slide bolt, in the region thereof that can be inserted into one another. As a result, the loading aid can be easily installed in the assembled magazine; all that is required is to insert the first and second slide into the slide receptacle, and to push the slides together, e.g. using fingers.

An aperture that proceeds from the bolt receptacle and, in the installation state, is connected to the hole, and at which aperture a stop face or support surface is formed, is particularly expedient. The stop face is preferably closer to the second grip than the support surface. An extension comprising a projection that protrudes in the radial direction and forms a latch and an end face is formed on the first slide, the latch being closer to the first grip than the end surface. The projection is designed so as to be complementary in shape to the aperture, and preferably faces downwards.

The advantage of this embodiment is that the latch of the first slide interacts with the support surface of the second slide, and prevents a relative movement of the first slide away from the second slide, in the axial direction of the second slide bolt. Furthermore, the end face of the first slide interacts with the stop face of the second slide, and prevents the relative movement between the first slide and the second slide, in the axial direction of the second slide bolt. In the installation state, the two slides of the loading aid are rigidly interconnected.

In other words, the extension can be resiliently deflected relative to the first slide bolt, in the direction of a collapse position. In the collapse position, the extension comprising the latch-forming projection is free from the support surface, allowing for the two slides to slide axially apart from one another.

It may furthermore be possible for the feeder to comprise a collapse opening that is designed as a hole and which makes the aperture, and thus the projection, accessible. A force effect on the projection, which effect is substantially normal to the axis of the second slide bolt, releases the latch from the support surface, and thus defines a collapse position.

A hole of this kind is advantageous in that light pressure can be exerted on the projection by means of a simple tool, such as a collapse pin, as a result of which the loading aid can be collapsed without problem, even on an assembled magazine. After pressure has been exerted on the projection, the loading aid is collapsed simply by gently pulling apart the two grips.

An advantageous embodiment is one according to which, on the first and/or second grip first and/or second lateral surfaces are formed so as to be complementary in shape to a groove side of the groove, and a first and/or second inner surface is formed so as to be complementary in shape to the groove base of the groove.

In this way, when the feeder is moved vertically in the slit, the first and second lateral surfaces can interact with the groove side, or first and second inner surfaces can interact with the groove base, and be guided thereby. This guidance stabilizes the orientation of the feeder in the x, y and z axis (x-axis: front/back; y-axis: left/right, and z-axis: vertical or in the direction of the magazine axis, and thus substantially in parallel with the slit), and thus acts against canting.

Particularly expediently, it may be possible for the slide receptacle to be designed so as to be complementary in shape to the first slide bolt. The complementary design promotes a secure seat of the loading aid in the slide receptacle.

A slide bolt that is designed so as to be circular in cross section is advantageous, since an embodiment of this kind is advantageous in terms of manufacture, and possible forces that may arise in the material can be diverted particularly successfully.

A further advantageous embodiment involves an elongated shape, similar to a slot, comprising two parallel longitudinal surfaces, in the cross section of the second slide bolt and the slide receptacle. Said parallel longitudinal surfaces interact with the slit side, and the feeder is thus additionally guided, during vertical movement, and the anti-canting effect is increased.

In a further advantageous embodiment, the cross section of the second slide bolt and the slide receptacle comprises an end face. Said end face makes it unlikely that the loading aid is installed with the incorrect orientation, i.e. in the orientation having the projection facing away from the hole.

A further advantageous embodiment comprises an asymmetry element somewhere on the cross section of the second slide bolt and the slide receptacle, the shape of which element also just allows precisely one orientation for installing the loading aid in the magazine. Installation in the incorrect orientation, i.e. having an indicator facing away from the loading state display, can be prevented.

It is furthermore possible for a first indicator to be arranged on the first slide and/or for a second indicator to be arranged on the second slide, and for a loading state display to be arranged on the magazine body, preferably on the side thereof. The indicator and/or loading state display can be optically, in particularly luminescent, and/or haptic perceptible, e.g. formed by means of a notch, depression and/or elevation.

An embodiment of this kind is advantageous in that the user can immediately and easily visually identify the loading state of the magazine. In the case of a luminescent design, optical identification is possible even in darkness. The haptic embodiment allows for identification of the loading state by feel, without visual contact.

It may furthermore be expedient for the grip surface of the first and/or second grip to be designed so as to be anti-slip and to comprise at least one anti-slip notch.

This is advantageous in that the feeder can be pushed slightly downwards, counter to the spring force, for the purpose of filling the magazine, and it is possible for the feeder to be shifted downwards in a reliable and trouble-free manner, and thus for the magazine to be filled easily, even in the case of low-friction, slippery conditions, e.g. hot, humid weather and sweat formation, or possible impurities on the hands and/or on the loading aid by lubricating or oily substances.

It is clear to a person skilled in the art that symmetrical embodiments are possible without difficulty, and can be read in passively along with both the description of the figures and the claims. In particular, embodiments of the magazine according to the present disclosure comprising at least two latches formed in the loading aid are possible. The feeder comprises a corresponding number of holes in order to make the latches accessible and to allow for the collapse process. For reasons of simplicity of representation and brevity of description, primarily an embodiment comprising just one latch will be described in the following description.

FIGS. 1 to 7 primarily show embodiments of the present disclosure that are suitable for use as stick magazines in a pistol. With knowledge of the magazines of the present disclosure, a person skilled in the art can transfer modifications of the examples shown and described to other types of magazines and/or firearms, such as rifles, easily and without significant or complex experimenting. Any other combinations of the technical features of the individual figures and the different embodiments thereof are easily possible for a person skilled in the art, with knowledge of the present disclosure.

Figure 1A:
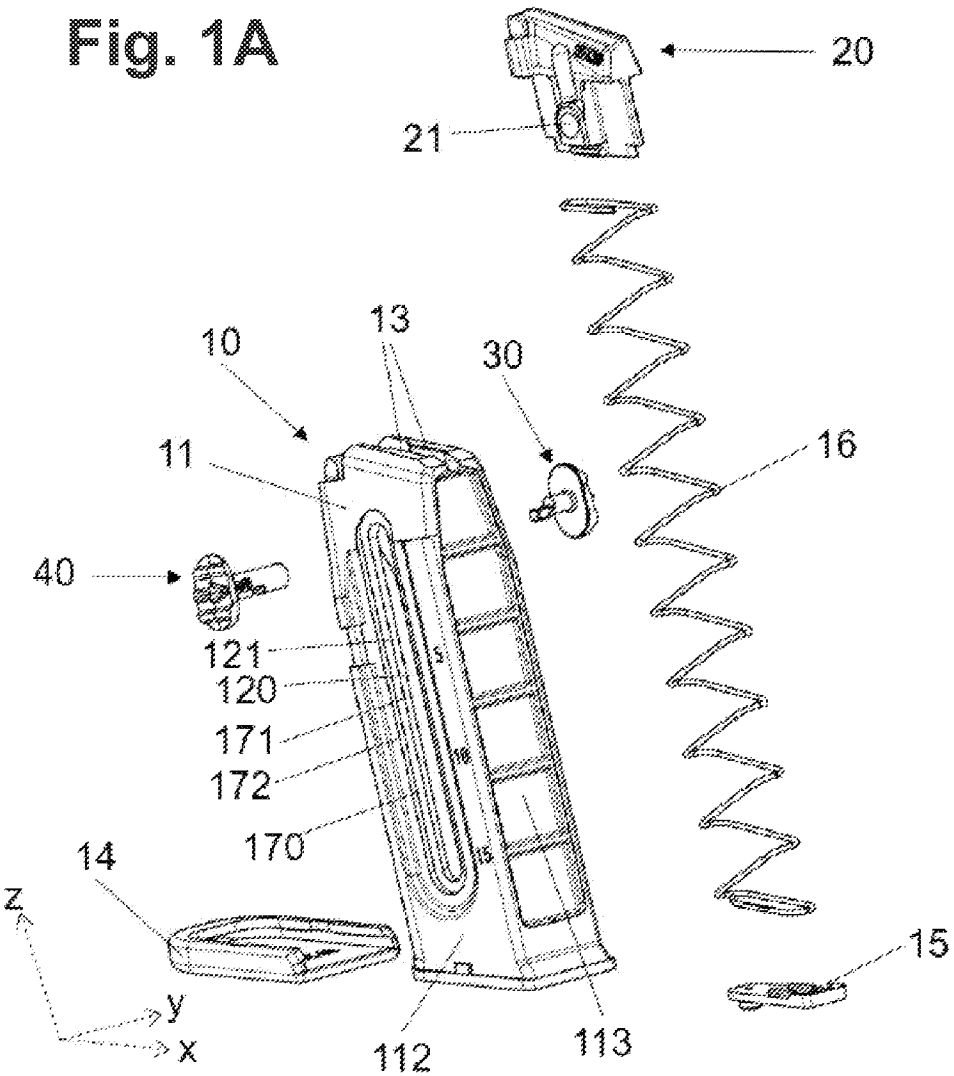

FIG. 1A is an exploded view of an embodiment, by way of example, of a magazine 10 according to the present disclosure. The magazine 10 comprises a magazine body 11 that is elongated in the vertical direction and has a substantially rectangular cross section in the vertical direction, and thus a narrower front surface 111 (FIG. 1B), a narrower rear surface 113, two wider sides 112, and an upper and a lower end. Furthermore, the magazine 10 comprises a magazine butt 14 that is fastened to the lower end of the magazine body 11, a magazine plate 15 that interacts with the magazine butt 14, lips 13 positioned on the upper end, a spring 16, as well as a feeder 20 that is likewise positioned on the upper end. In the assembled state of the magazine, the feeder 16 is connected to the feeder 20, at one end, and to the magazine butt 14, by means of the magazine plate 15, at the other end. The feeder 20 is pushed upwards, in the direction of the lips 15, by the spring force. Thus, in the filled state, after removal of the first cartridge in each case, the next is advanced upwards. The magazine 10 is filled by inserting cartridges into the magazine from above, by exerting pressure on the feeder 20, counter to the force of the spring 16.

On the sides 112 thereof, the magazine body 11 comprises an elongated slit 120, oriented substantially in the vertical direction, in each case, which slit ends at a distance both from the butt 14 and from the lips 13, such that the sides 113 of the magazine body 11 are continuous in each case, at the top and bottom.

In the preferred embodiment shown, the magazine body 11 comprises, on the sides 112 thereof along the slit 120, a groove 170 comprising a groove base 171 and groove side 172, the groove base 171 being designed so as to be substantially in parallel with, and the groove side 172 being designed so as to be substantially normal to, the side 112.

The loading aid consists of a first slide 30 and a second slide 40 and, in the installed state, is arranged in a slide receptacle 21 of the feeder 20. In the installed state, the assembled loading aid penetrates the magazine body 11 in the region of the slit 120; and is recessed with respect to, or flushes with, the sides 112. During the loading process of the magazine 10, the loading aid is repositioned in the slit 120, counter to the force of the spring 16, filling of the magazine 10 with cartridges being facilitated by the feeder 20 that is pushed down by the loading aid.

FIG. 1B is a side view of the magazine of FIG. 1A. The loading state display 19, as well as the width B1 of the slit 120 and the width B2 of the groove 170, are clearly visible.

Figure 2:
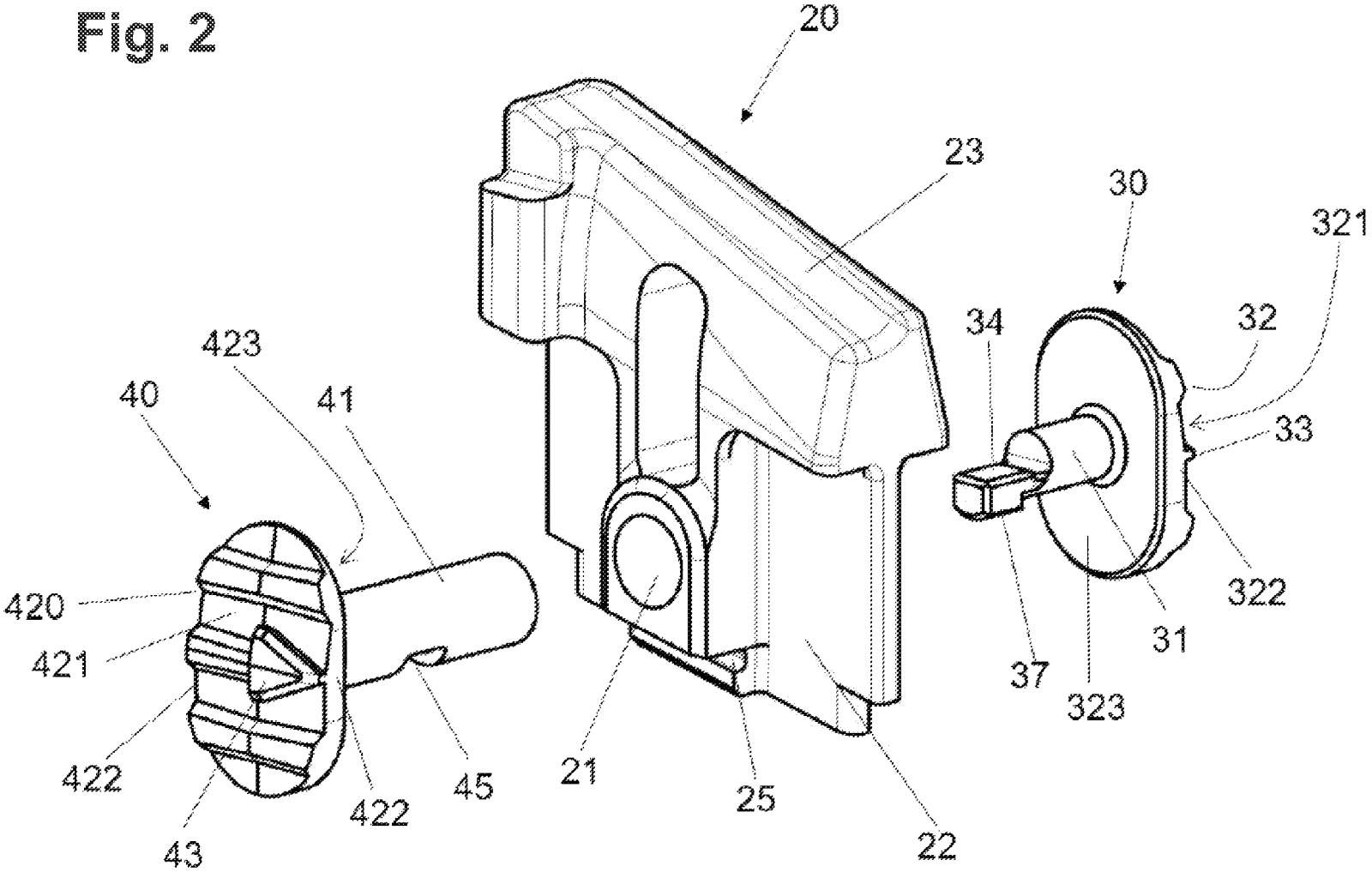
FIG. 2 is a perspective detailed view of an exemplary feeder together with a loading aid, prior to assembly, according to the present disclosure.

FIG. 2 is an axial exploded view of the feeder 20 comprising the loading aid. The contact surface 23 which, when the magazine 10 is full, is in contact with the bottom-most cartridge, is located at the top. The spring seat 25 that is arranged on the neck 22 and at which the spring is connected to the feeder 20, is also visible. The loading aid consisting of the first and the second slide 30 and 40 is arranged in the slide receptacle 21. The first slide 30 comprises a first slide bolt 31 comprising an extension 34 and projection 37. The second slide 40 comprises a second slide bolt 41 comprising an aperture 45, a second grip 420, and an optional second indicator 43. The optional second indicator 43 is shown, by way of example, in the form of an arrow.

Figure 3:
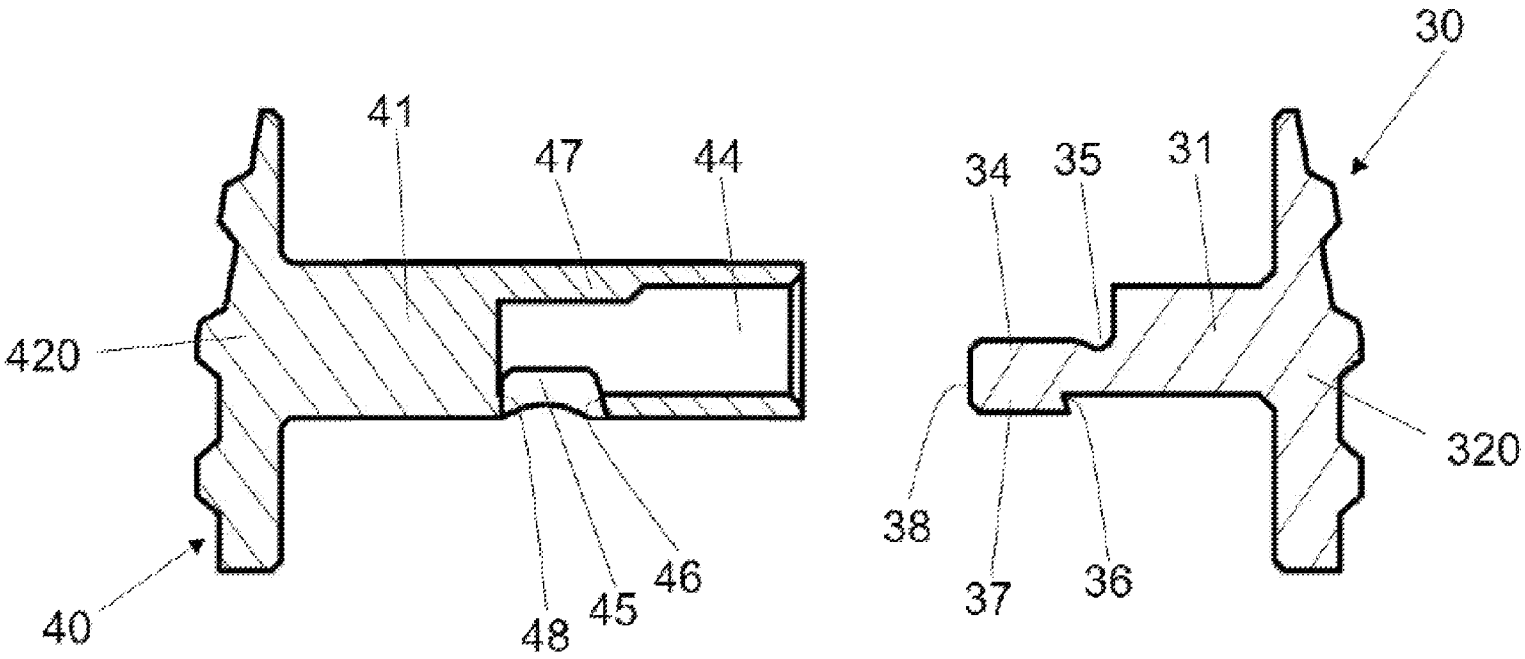
FIG. 3 is an axial section through the loading aid in the collapsed state.
Figure 4:
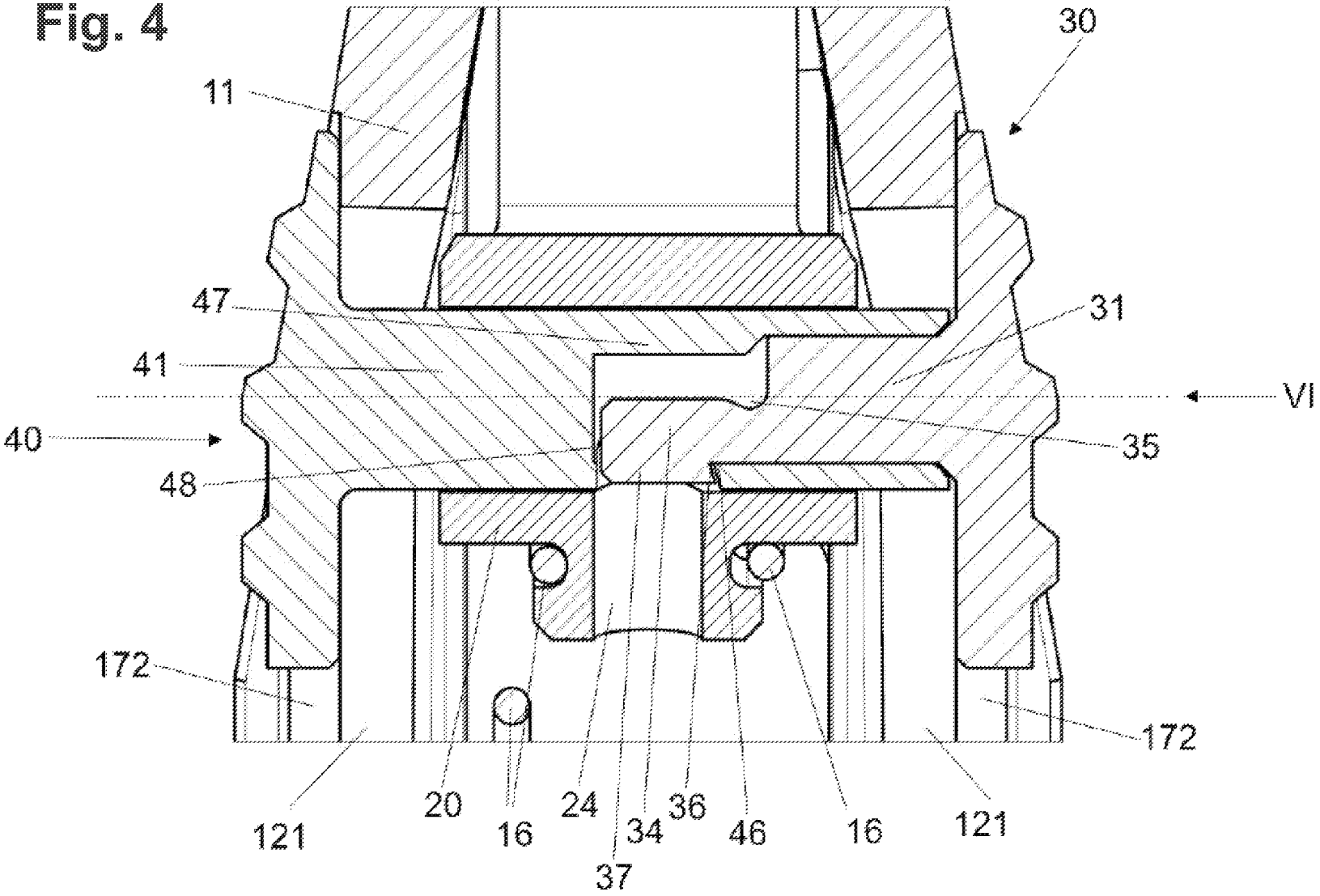
FIG. 4 is an axial section of the loading aid in the feeder, in the installed state, from behind.

FIG. 3 is a cross section of the loading aid in the collapsed state, along the line IV-IV of FIG. 1B, without the surrounding components; FIG. 4 is the same cross section in the installation state, together with the surrounding components.

As is particularly clearly visible in FIGS. 3 and 4, the first slide bolt 31 is complementary in shape to the bolt recess 44 and can be received thereby. The extension 34 comprising the projection 37, the latch 36 and the end face 38 are formed so as to be complementary in shape to the bolt recess 44 comprising the aperture 45. As shown, the bolt recess 44 preferably comprises a taper 47, a support surface 46 and a stop face 48. In order to assemble the loading aid, the extension 34 of the first slide 30 is inserted into the bolt recess 44 of the second slide, in the axial direction of the second slide (denoted VI in FIG. 4), the projection 37 being oriented in the direction of the hole 24 (downwards in the example shown in FIG. 4). The extension 34 is designed so as to be resiliently deformable relative to the first slide bolt 31, which allows for simple assembly, and collapse. Pushing together the slides 30 and 40 in the axial direction VI causes said slides to be moved relative to one another, and the first slide 30 to press into the second slide 40. The further the first and second slides 30 and 40 are moved inside one another, the more the extension 34 is deflected upwards, in accordance with the principle of a leaf spring. If the extension 34 comprising the projection 37 fully reaches the aperture 45, the extension 34 springs back into the original position thereof. The coupling is achieved by latching of the projection 37, or the latch 36 thereof, on the support surface 46 of the aperture 45. Preferably, as shown, the end face 38 strikes the stop face 48 at the same time, as a result of which both an axial and a rotational movement of the first slide 30 relative to the second slide 40 Is prevented.

In order to collapse the loading aid, pressure is exerted on the projection 37 from below, and presses said projection out of the aperture 45, by means of resilient deformation. In this case, the support surface 46 releases the latch 36, and the first slide 30 can be moved out of the second slide 40, in the axial direction. In addition to a suitable material selection, the particular design of the bending groove 35 (in the manner of a taper of the cross-sectional surface area) assists this procedure, since this allows for and/or facilitates spring deflection of the extension 34 upwards. The collapse position is thus achieved in that a force that is substantially normal to the axis of the second slide bolt 41 acting on the projection 37, through the hole 24, releases the latch 36 from the support surface 46.

As shown in FIG. 4, the feeder 20 comprises a hole 24 for allowing for access to the projection 37, and thus collapse of the loading aid in the state when installed in the magazine 10, using a simple tool, e.g. a collapse pin. Embodiments comprising at least two latches 36 formed on the loading aid are also possible. The feeder 20 then comprises a corresponding number of holes 24 in order to make the latches 36 accessible and allow for the collapse process.

In a preferred embodiment, the first and second grip 330 and 430 are positioned completely in the groove 170 of the slit 120, and end flush with the sides 112 of the magazine body 11. A cross section of the first and second grip 320 and 420 that tapers inwards, towards the top, and is thus slightly triangular, can be seen particularly clearly in FIG. 3, which cross section is designed in a manner corresponding to the shape of the magazine body, which is slightly tapered at the upper end. Therefore, in the position in the upper end region of the magazine 10, the first and second grip 320 and 420 are also flush with the magazine body 11, and, even when a magazine 10 has been pushed into the magazine shaft, the loading aid is freely movable, over the entire length of the slit 120, from this side.

In a preferred embodiment, and as shown in FIG. 2, the grips 320 and 420 are designed so as to elongate in the vertical direction, and in each case comprise two at least approximately mutually parallel and vertically extending first and second side faces 322 and 422. The normal mutual spacing both between the two first side faces 322 and the two second side surfaces 422 corresponds to the width B2 of the groove 170 (shown in FIG. 1*b*). In the installation state, the two grips 320, 420 are guided in the associated groove 170 in each case, on the associated side 112 of the magazine 10, the first and second lateral surfaces 322 and 422, which are parallel in each case, also being oriented so as to be in parallel with the relevant groove 170. The groove side 172 that is accordingly associated with the first and/or second grip 320, 420 guides the lateral faces 322, 422, it being possible for the inner faces 323, 423 to also be oriented so as to be in parallel with the associated groove 170 and to be guided by the associated groove 171.

Interaction of lateral faces 322, 422 with groove sides 172, or of inner faces 323, 423 with groove bases 171, makes it possible to prevent canting in the x, y and z direction of the feeder, during movement in the vertical direction. This anti-canting effect facilitates the loading process and also promotes an optimized cartridge supply when in use, and impedes possible jamming.

Figure 7A:
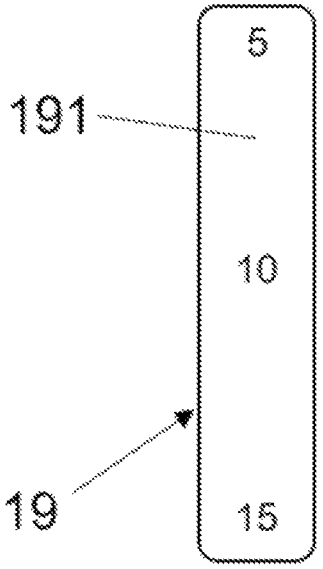
FIGS. 7A and 7B are purely schematic views showing different embodiment of exemplary loading state display of the present disclosure.
Figure 7B:
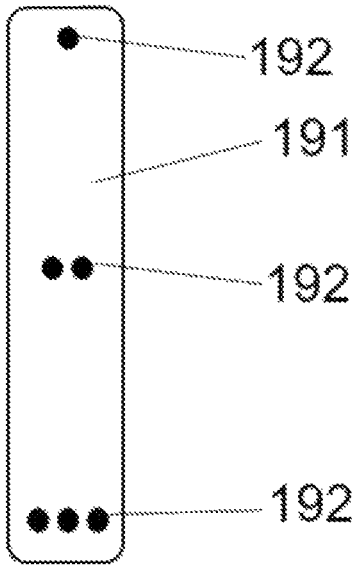

The width/the diameter of the second slide bolt 41 substantially corresponds to the width B1 of the slit 120 (FIG. 1B), and the loading aid is guided in the slit 120 to as to be movable in the vertical direction. In a preferred embodiment, the slit 120 can be closed and sealed by means of sealing elements, such as sealing lips or a brush seal. The sealing elements for intermittent closing of the slit 120 are arranged on the magazine body such that a vertical movement of the loading aid remains possible. In this case, a flexible design of the sealing elements is advantageous, as a result of which the slit 120 remains sealed with respect to the inside, even when the feeder 20 is moved. As a result, undesired penetration of foreign bodies, such as dust, sand, dirt and moisture is impeded, promoting the movability of the feeder 20 and decreasing the likelihood of jamming. As shown in FIGS. 7A and 7B, a first and/or second indicator 33, 34 is preferably attached to the first and/or to the second slide 30, 40; e.g. on the first or second grip surface 321 and 421 of the first or second grip 320 and 420. The first and/or second indicator 33 and 43 interacts with an associated loading state display 19, and shows the actual filling level of the magazine. The indicator can be designed so as to be optically and/or haptically perceptible. For example, the indicator can be designed as an arrow or line marking, and/or as an elevation or notch, and/or so as to be luminescent, i.e. to be easily identifiable, even in the dark. The loading state display 19 can for example be designed for example to be optically and/or haptically perceptible and/or luminescent, by attaching numbers and/or symbols, the minimum and maximum filling level, as well as intermediate steps. Depending on the filling level of the magazine, the loading aid, and thus the first and/or second indicator 34 and 44, is in different vertical positions, and points to the associated point on the loading state display 19, as a result of which the filling level (filling state) of cartridges in the magazine can be made visible.

Figure 5:
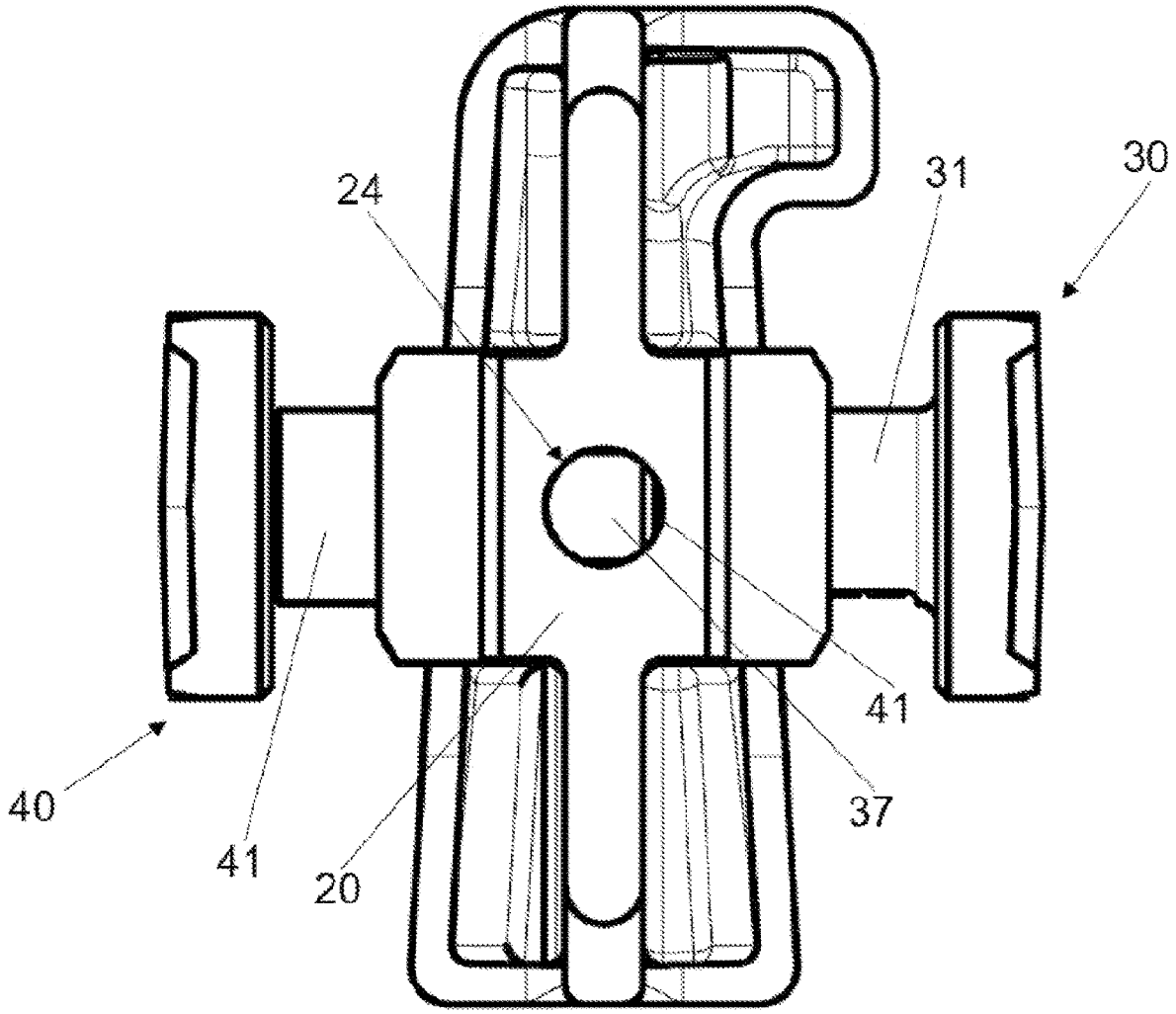
FIG. 5 shows the loading aid in the feeder, in the installed state, from below.

FIG. 5 is a view from below of an embodiment of a feeder 20 of the magazine 10 according to the present disclosure, having an inserted loading aid, the two slides 30, 40 being visible. In particular, the hole 24 can be seen in the middle of the feeder 20, together with the projection 37 of the first slide 30 located therebehind. The hole 24 makes it possible to exert pressure in the upwards direction, on the projection 37 and thus the extension 34, in order to collapse the loading aid by means of engagement using a simple tool, such as a collapse pin. As described above, in this way the latch 36 is released from the support surface 46, and the axial movement of the first and second slide 30 and 40 away from one another is made possible. The position in which the latch 36 is released from the support surface 46 is referred to as the collapse position.

Figure 6A:
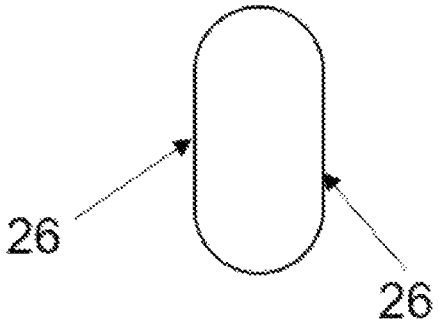
FIGS. 6A, 6B, and 6C are purely schematic cross-section views of various exemplary embodiments of the slide receptacle according to the present disclosure.
Figure 6B:
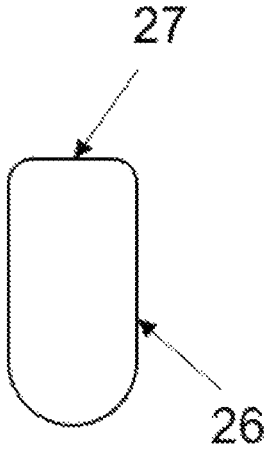
Figure 6C:
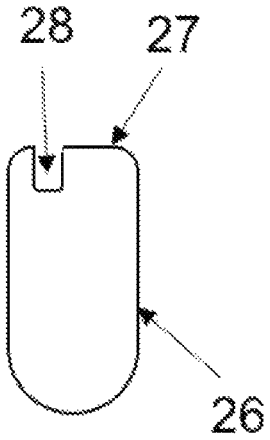

FIGS. 6A-6C are schematic cross sections of examples for possible designs of the cross section of the slide receptacle 21, and thus the slide bolts 31, 41. The loading aid, in particular the first slide bolt 41 is of a corresponding design that is complementary in shape. In addition to the circular design that is clearly visible in FIGS. 1 and 2, the slide receptacle can for example also be of an extended shape, similar to a slot, comprising two parallel longitudinal surfaces 26 FIG. 6A. The longitudinal surfaces 26 interact with the slit surface 121 and once again increase the above-described anti-canting effect.

FIG. 6B shows a variant comprising an additional end face 27. The end face 27 prevents incorrect insertion of the loading aid, having the aperture 45 and projection 37 oriented away from the hole 24. In conjunction with the examples of FIGS. 1 to 5, the loading aid could be inserted only in a manner having the aperture 45 and projection 37 facing downwards, and thus facing towards the hole 24. FIG. 6C shows a further possible design of the cross section of the slide receptacle 21, in which an asymmetry element 28 results in an entirely asymmetrical cross section. As a result, the loading aid can be inserted only in precisely one orientation, in which the aperture 45 faces the projection 37 and the hole 24, and the first and/or second indicator 34, 44 faces the loading aid 19. An asymmetrical cross section of this kind can of course also be of different designs.

FIGS. 7A and 7B show examples of possible embodiments of the loading state display 19. The loading state display can be designed so as to be at least optically perceptible, e.g. in the form of (a) number(s) or (a) symbol(s) that is/are printed on, engraved, or embossed into the material. In addition, the loading state display can also be designed so as to be haptically perceptible. For example, the loading state display 19 can be designed having numbers and/or symbols that are significantly notches, and thus easy to feel. In a preferred embodiment, the loading state display is formed on the magazine body 11, in that the numbers and/or symbols are formed as elevated points or elevations 192, in a manner similar to braille. Said elevations 192 can also be formed in a recessed region 191. The elevations 192 are preferably formed such that they do not protrude relative to the outer contour of the magazine 10, in order to allow for simple replacement of the magazine.

The loading state display 19 can also be designed so as to be luminescent, i.e. easy to identify even in the dark. Loading state displays having an individual optical or haptic design are possible, or a combination of a plurality of optical and/or haptic designs.

It should also be specifically noted that the specified coordinate system does not have to be orthogonal, and can also rotate relative to the magazine butt, and/or the angle of the z-axis with respect to the plane spanned by xy can change, with the position considered in each case, in particular in the case of curved magazines, since said coordinate system is used only to explain the situation present in each case.

The magazine 10 according to the present disclosure can, for example, be produced largely from plastics material or metal. Furthermore, different material combinations of plastics material, metal, ceramic or composite materials are possible.

The magazine according to the present disclosure can be produced for example by means of machining processes, such as milling, turning or grinding, and likewise the magazine according to the present disclosure can be produced by means of shaping processes, such as injection molding, extrusion or MIM, or alternatively also by means of additive manufacturing processes such as 3D printing, or a combination of these or similar methods.

| List of reference signs: | |
|---|---|
| 10 | Magazine |
| 11 | Magazine body |
| 111 | Front surface |
| 112 | Side |
| 113 | Rear surface |
| 120 | Slit |
| 121 | Slit surface |
| 13 | Lips |
| 14 | Magazine butt |
| 15 | Magazine plate |
| 16 | Spring |
| 170 | Groove |
| 171 | Groove base |
| 172 | Groove side |
| 19 | Loading state display |
| 191 | Recessed region |
| 192 | Elevation |
| 20 | Feeder |
| 21 | Slide receptacle |
| 22 | Neck |
| 23 | Contact surface (for bottommost cartridge) |

-continued

| List of reference signs: | |
|---|---|
| 24 | Hole |
| 25 | Spring seat |
| 26 | Longitudinal surface |
| 27 | End face |
| 28 | Asymmetry element |
| 30 | First slide |
| 31 | First slide bolt |
| 320 | First grip |
| 321 | First grip surface |
| 322 | First lateral face |
| 323 | First inner face |
| 33 | First indicator |
| 34 | Extension |
| 35 | Bending groove |
| 36 | Latch |
| 37 | Projection |
| 38 | End face |
| 40 | Second slide |
| 41 | Second slide bolt |
| 420 | Second grip |
| 421 | Second grip surface |
| 422 | Second lateral surface |
| 423 | Second inner face |
| 43 | Second indicator |
| 44 | Bolt recess |
| 45 | Aperture |
| 46 | Support surface |
| 47 | Taper |
| 48 | Stop face |

The invention claimed is:

1. A magazine for a firearm, comprising:

a magazine body having two sides, including at least one slit in each of the two sides;

a feeder, the feeder defining a slide receptacle extending through the feeder; and a loading aid;

wherein the loading aid includes a first and a second slide that are configured to be reversibly coupled to each other inside the slide receptacle by a latch, so that a first side face of the first slide and a second side face of the second slide are each disposed outside the magazine body; and the feeder defines at least one hole in a direction of the slide receptacle to permit an uncoupling of the latch.

2. The magazine according to claim 1, wherein the first and the second slide are configured such that they can be inserted into one another.

3. The magazine according to claim 1, wherein the first slide includes a first slide bolt, and the second slide includes a second slide bolt defining a bolt recess that is substantially complementary in shape to the first slide bolt.

4. The magazine according claim 3, wherein the second slide further defines an aperture that is connected to the bolt recess and faces the hole defined by the feeder when in an installed state.

5. The magazine according to claim 4, wherein the first side face of the first slide includes a first grip, and the second side face of the second slide includes a second grip; and the loading aid further comprises a support surface and a stop face formed on the aperture of the second slide such that the stop face is closer to the second grip than to the support surface.

6. The magazine according to claim 5, wherein the first side face of the first slide includes a first grip and the second side face of the second slide includes a second grip, further comprising:

an extension formed on the first slide;

an end face formed on the extension; and a projection that protrudes from the extension in a radial direction to form the latch such that the latch is closer to the first grip than to the end face.

7. The magazine according to claim 6, wherein the projection protrudes downwardly from the extension.

8. The magazine according to claim 6, wherein the projection is complementary in shape to the aperture.

9. The magazine according to claim 6, wherein the extension can be resiliently deflected relative to the first slide bolt such that the projection is free from the support surface.

10. The magazine according to claim 6, wherein each of the two sides of the magazine body includes a groove along the at least one slit, where the groove includes a groove base and a groove side;

further comprising:

a first and/or a second lateral surface formed on the first and/or the second grip, respectively, where the first and/or the second lateral surfaces are complementary in shape to the groove side of the groove on a corresponding side of the magazine body; and a first and/or second inner surface formed on the first and/or second grip, respectively, where the first and/or second inner surfaces are complementary in shape to the groove base of the groove on the corresponding side of the magazine body.

11. The magazine according to claim 5, wherein the first grip includes a first grip surface, the second grip includes a second grip surface, and each of the first grip surface and the second grip surface define at least one anti-slip notch.

12. The magazine according to claim 3, wherein a cross section of the slide receptacle is complementary in shape to a cross section of the second slide bolt.

13. The magazine according to claim 3, wherein the second slide bolt has a circular cross section.

14. The magazine according to claim 3, wherein a cross section of the second slide bolt includes two parallel longitudinal surfaces that define a slot.

15. The magazine according to claim 14, wherein the cross section of the second slide bolt includes at least one end face that is oriented so as to be at least substantially normal to the two parallel longitudinal surfaces.

16. The magazine according to claim 3, wherein a cross section of the second slide bolt includes at least one asymmetry element.

17. The magazine according to claim 1, further comprising a first indicator arranged on the first slide and/or a second indicator arranged on the second slide, and a loading state display arranged on the magazine body.

18. The magazine according to claim 17, wherein the loading state display is arranged on one side of the magazine body.

19. The magazine according to claim 17, wherein one or more of the first indicator, the second indicator, and the loading state display are optically and/or haptically perceptible.

20. The magazine according to claim 19, wherein one or more of the first indicator, the second indicator, and the loading state display are optically perceptible due to luminescence.

21. The magazine according to claim 1, wherein the magazine body further comprises one or more sealing elements for intermittent closure of the at least one slit in each of the two sides, such that vertical movement of the loading aid remains possible.

* * * * *